US012497860B1

(12) United States Patent
Deng et al.

(10) Patent No.: US 12,497,860 B1
(45) Date of Patent: Dec. 16, 2025

(54) INFLOW CONTROL SYSTEM FOR A BOREHOLE, AND METHOD

(71) Applicant: Baker Hughes Oilfield Operations LLC, Houston, TX (US)

(72) Inventors: Guijun Deng, The Woodlands, TX (US); Sandip Maity, Juffair (BH); Oscar Becerra Moreno, Katy, TX (US); Vimal Shah, Sugar Land, TX (US); Anil Sadana, Houston, TX (US); Zhihui Zhang, Katy, TX (US)

( * ) Notice: Subject to any disclaimer, the term of this patent is extended or adjusted under 35 U.S.C. 154(b) by 0 days.

(21) Appl. No.: 18/903,430

(22) Filed: Oct. 1, 2024

(51) Int. Cl.
*E21B 34/06* (2006.01)
*E21B 41/00* (2006.01)

(52) U.S. Cl.
CPC ..... *E21B 34/066* (2013.01); *E21B 41/0085* (2013.01)

(58) Field of Classification Search
CPC ..... E21B 34/066; E21B 41/0085
See application file for complete search history.

(56) References Cited

U.S. PATENT DOCUMENTS

| | | | | |
|---|---|---|---|---|
| 6,464,011 | B2 | 10/2002 | Tubel | |
| 10,738,574 | B2 | 8/2020 | Abdelfattah et al. | |
| 11,746,627 | B1 | 9/2023 | Jaaskelainen | |
| 2011/0180267 | A1 | 7/2011 | Wildman et al. | |
| 2016/0010427 | A1* | 1/2016 | Kelbie | E21B 34/066 166/373 |
| 2016/0024869 | A1* | 1/2016 | Vachon | E21B 34/066 166/368 |
| 2016/0145975 | A1* | 5/2016 | Carroll | H02K 7/1823 166/244.1 |
| 2021/0222522 | A1* | 7/2021 | Greci | E21B 47/01 |
| 2024/0052731 | A1* | 2/2024 | Shaw | E21B 47/008 |
| 2024/0117715 | A1* | 4/2024 | Vehra | H02J 7/0013 |
| 2024/0352830 | A1* | 10/2024 | McChesney | H02K 7/1823 |

FOREIGN PATENT DOCUMENTS

| | | |
|---|---|---|
| CN | 105422050 B | 11/2017 |
| CN | 108060915 | 3/2024 |

* cited by examiner

*Primary Examiner* — Brad Harcourt
(74) *Attorney, Agent, or Firm* — Baker Hughes Company

(57) ABSTRACT

An inflow control system for a borehole, including a plurality of electrically controlled inflow control devices (ICDs), a plurality of power sources, at least one source being connected to one of the ICDs and also being connectable to another of the ICDs, and a downhole controller operably connected to the ICDs and to the power sources, the controller configured to modify power supply from the power sources to the ICDs. A method for managing inflow in a wellbore, including powering a plurality of inflow control devices (ICDs) with a plurality of power sources, managing power distribution to the plurality of ICDs from the plurality of power sources with a downhole controller. A wellbore system including a borehole in a subsurface formation, a string in the borehole, and an inflow control system, disposed within or as a part of the string.

15 Claims, 2 Drawing Sheets

INFLOW CONTROL SYSTEM FOR A BOREHOLE, AND METHOD

BACKGROUND

In the resource recovery and fluid sequestration industries, flow control devices, including inflow control devices, are known to the art and are used to manage fluid fronts to maximize desirable fluid flow while reducing undesirable fluid flow. Control and autonomy of such systems is desired but lacking in the art. Innovations that improve control and autonomy will be well received by the art.

SUMMARY

An embodiment of an inflow control system for a borehole, including a plurality of inflow control devices (ICDs) each being electrically controlled, a plurality of power sources, at least one power source of the plurality of power sources being connected to one of the plurality of ICDs and also being connectable to another of the plurality of ICDs, and a downhole controller operably connected to the plurality of ICDs and to the plurality of power sources, the controller configured to modify power supply from the plurality of power sources to the plurality of ICDs.

An embodiment of a method for managing inflow in a wellbore, including powering a plurality of inflow control devices (ICDs) with a plurality of power sources, managing power distribution to the plurality of ICDs from the plurality of power sources with a downhole controller.

An embodiment of a wellbore system including a borehole in a subsurface formation, a string in the borehole, and an inflow control system, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
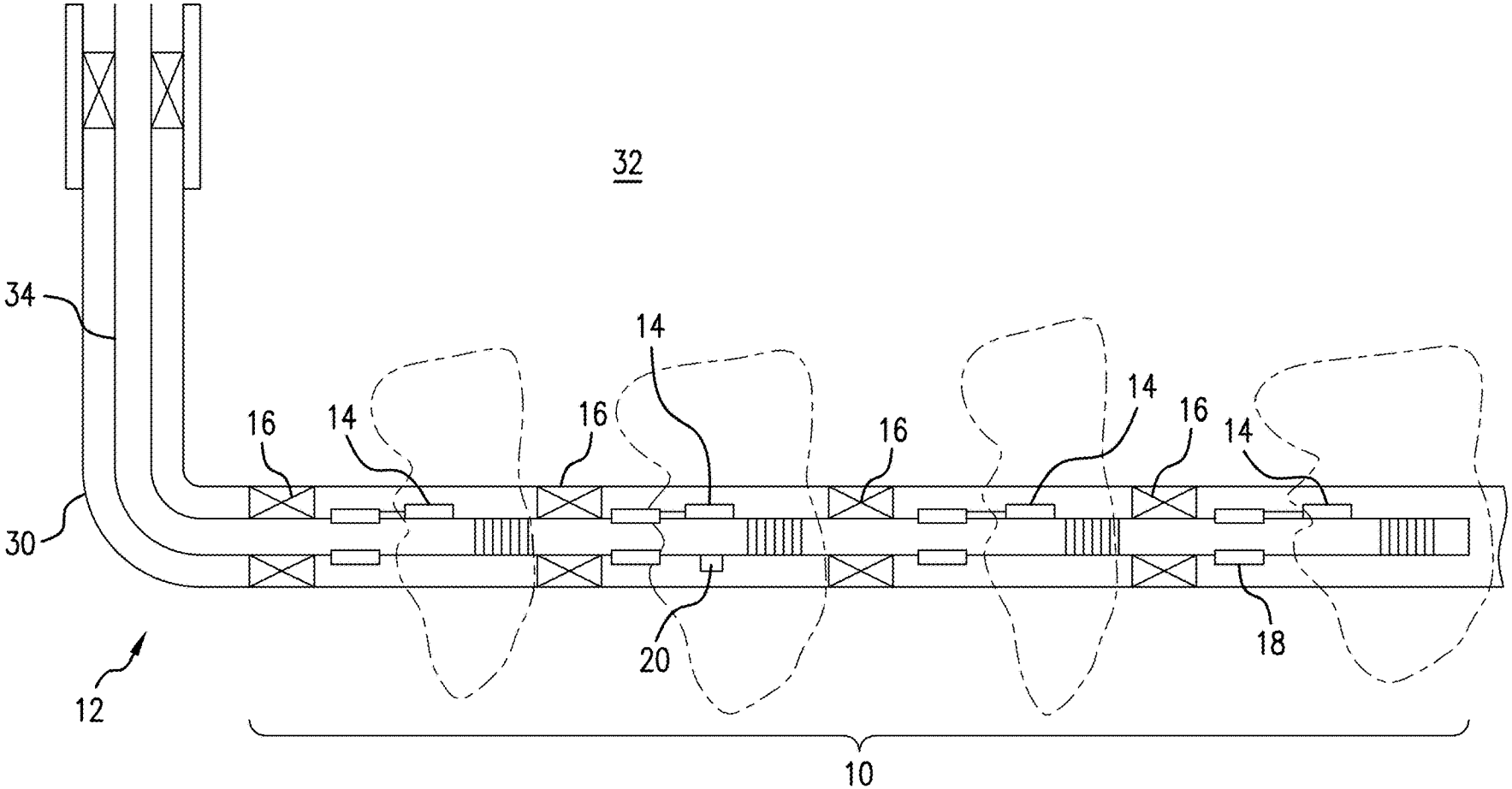
FIG. 1 is a schematic view of an inflow control system for a borehole as disclosed herein.

Referring to FIG. 1, a schematic view of an inflow control system 10 which may be an autonomous system, disposed in a wellbore system 12 is illustrated. System 10 comprises a plurality of inflow control devices (ICDs) 14 each being electrically controlled and responsive to resistivity of the fluid in contact with the ICD. In other embodiments, the ICDs 14 may be responsive to fluid density or viscosity detected by sensors such as a microfluidic sensor, an acoustic resonance sensor, etc. In an embodiment, each ICD 14 may be segregated to a zone by packers 16. Further, each of the ICDs requires a power source 18. In some embodiments, individual power sources 18 are supplied for each ICD while in other embodiments, a single power source 18 may be provided for one or more of the plurality of ICDs 14. In all embodiments, a downhole controller 20 is connected to each power source 18 and to each ICD 14 and is configured to manage power supply from the power sources 18 to the ICDs 14. The system 10 allows for power to be maintained at each ICD 14 even if one of the power sources 18 fails or is not provided with sufficient flow (in the case of a turbine generator). Moreover, the controller 20 is configured to monitor fluids flowing through the ICDs using sensors located within the ICDs or in a flow stream coming from the ICD 14 and modify operational parameters of the individual ICDs 14 to maximize desirable flow while minimizing undesirable flow. Workable sensors are known to the art and do not require particular disclosure. The management may include throttling power to ICDs 14 flowing undesirable fluid while providing additional power to ICDs 14 flowing desirable fluids.

Figure 2:
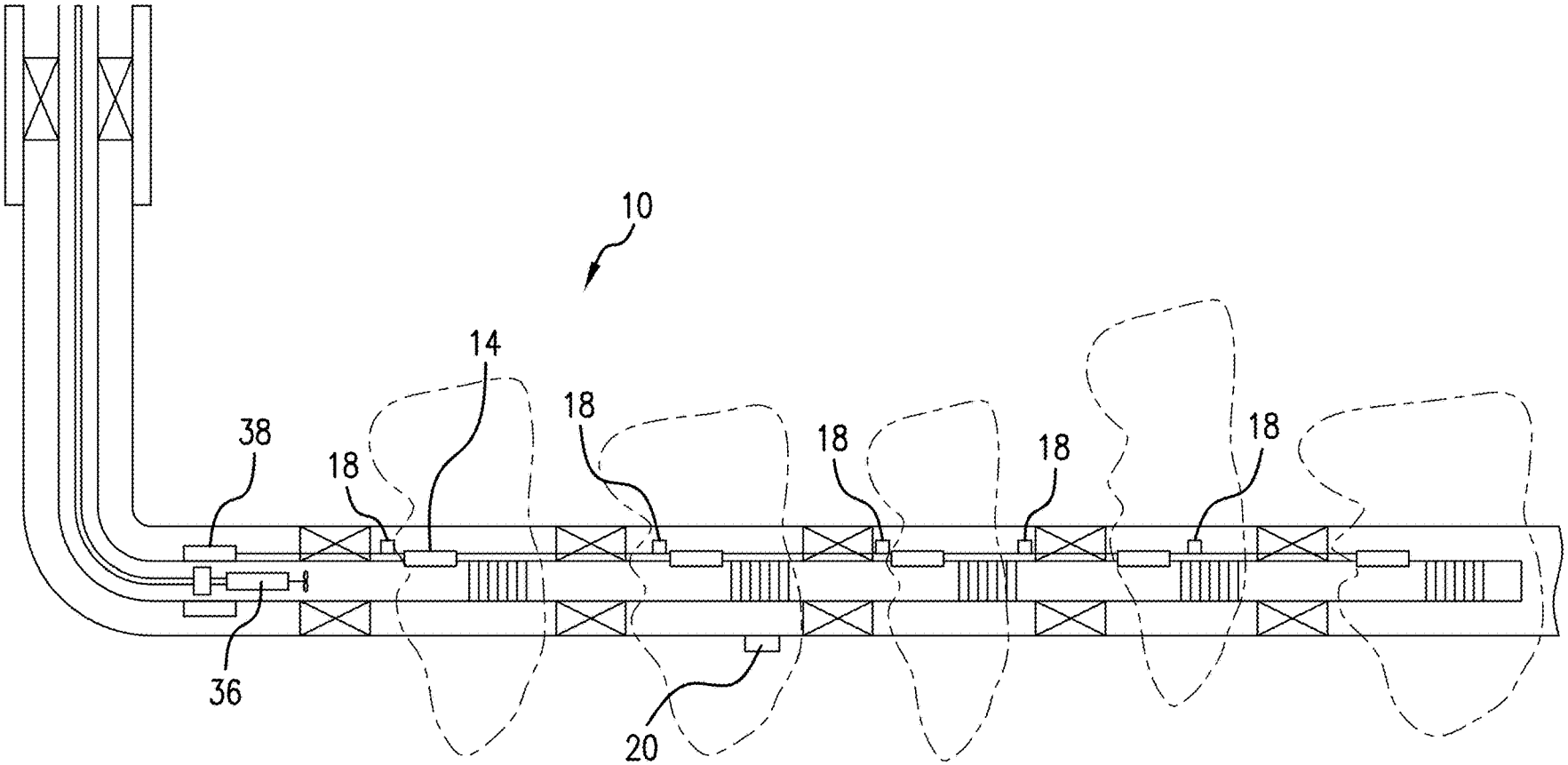
FIG. 2 is an alternate embodiment of that illustrated in FIG. 1.

The power sources 18 may, in an embodiment, be turbine generators. In another embodiment, the power source is batteries. Where batteries are used, a charging apparatus is included in system 10 (see FIG. 2). The charging apparatus 36 may charge one or more of the batteries and is runnable separately into the borehole to a charging station 38 that is connected to one or more of the power sources 18 and configured to supply power thereto to charge the same and/or directly power the ICDs. The system may also be configured to provide both continuous power to the batteries for charging and power to the ICDs. Charging may occur periodically, such as about every three months, in an embodiment.

The system 10 is a fully autonomous flow control system since it has its own power source(s), its own valves (ICDs), and its own controller to manage the system.

Finally, the wellbore system 12 comprises a borehole 30 in a subsurface formation 32, a string 34 in the borehole, and an inflow control system 10 as described above, disposed within or as a part of the string 34. This wellbore system leverages the inflow control system in an autonomous way to optimize fluid management within the borehole, enhancing the efficiency and effectiveness of resource extraction or fluid sequestration.

Set forth below are some embodiments of the foregoing disclosure:

Embodiment 1: An inflow control system for a borehole, including a plurality of inflow control devices (ICDs) each being electrically controlled, a plurality of power sources, at least one power source of the plurality of power sources being connected to one of the plurality of ICDs and also being connectable to another of the plurality of ICDs, and a downhole controller operably connected to the plurality of ICDs and to the plurality of power sources, the controller configured to modify power supply from the plurality of power sources to the plurality of ICDs.

Embodiment 2: The system as in any prior embodiment, wherein the controller is configured to divert power from one of the plurality of power sources to another of the plurality of ICDs, in whole or in part.

Embodiment 3: The system as in any prior embodiment, wherein the controller manages power supply to each of the plurality of ICDs.

Embodiment 4: The system as in any prior embodiment, wherein each of the plurality of ICDs has one of the plurality of power sources connected thereto, and the number of power sources is equal to the number of ICDs.

Embodiment 5: The system as in any prior embodiment, wherein the plurality of power sources includes a plurality of generators.

Embodiment 6: The system as in any prior embodiment, wherein the plurality of generators are turbines.

Embodiment 7: The system as in any prior embodiment, wherein the controller monitors output from the plurality of turbines and manages power supply to the plurality of ICDs based upon the output from the plurality of turbines.

Embodiment 8: The system as in any prior embodiment, wherein the controller further monitors fluid properties from each of the plurality of ICDs and reduces or increases power to individual ones of the plurality of ICDs based upon desirable and undesirable properties, respectively.

Embodiment 9: The system as in any prior embodiment, wherein the controller operates autonomously.

Embodiment 10: The system as in any prior embodiment, wherein the plurality of power sources are batteries.

Embodiment 11: The system as in any prior embodiment, wherein a charger is connected to the batteries.

Embodiment 12: The system as in any prior embodiment, wherein the charger is a single charger connected to all batteries.

Embodiment 13: A method for managing inflow in a wellbore, including powering a plurality of inflow control devices (ICDs) with a plurality of power sources, managing power distribution to the plurality of ICDs from the plurality of power sources with a downhole controller.

Embodiment 14: The method as in any prior embodiment, wherein the managing is diverting power from certain one(s) of the plurality of ICDs and supplying the diverted power to other one(s) of the plurality of ICDs.

Embodiment 15: The method as in any prior embodiment, wherein the managing includes monitoring of fluid properties in the plurality of ICDs and distributing power based upon the properties.

Embodiment 16: The method as in any prior embodiment, wherein the managing is autonomous.

Embodiment 17: A wellbore system including a borehole in a subsurface formation, a string in the borehole, and an inflow control system as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An inflow control system for a borehole, comprising:

a plurality of inflow control devices (ICDs) each being electrically controlled;

a plurality of power sources, at least one power source of the plurality of power sources being connected to one of the plurality of ICDs and also being connectable to another of the plurality of ICDs; and a downhole controller operably connected to the plurality of ICDs and to the plurality of power sources, the controller configured to modify power supply from the plurality of power sources to the plurality of ICDs, wherein the controller further monitors fluid properties from each of the plurality of ICDs and reduces or increases power to individual ones of the plurality of ICDs based upon desirable and undesirable properties, respectively.

2. The system as claimed in claim 1, wherein the controller is configured to divert power from one of the plurality of power sources to another of the plurality of ICDs, in whole or in part.

3. The system as claimed in claim 1, wherein the controller manages power supply to each of the plurality of ICDs.

4. The system as claimed in claim 1, wherein each of the plurality of ICDs has one of the plurality of power sources connected thereto, and the number of power sources is equal to the number of ICDs.

5. The system as claimed in claim 1, wherein the plurality of power sources includes a plurality of generators.

6. The system as claimed in claim 5, wherein the plurality of generators are turbines.

7. The system as claimed in claim 6, wherein the controller monitors output from the plurality of turbines and manages power supply to the plurality of ICDs based upon the output from the plurality of turbines.

8. The system as claimed in claim 1, wherein the controller operates autonomously.

9. The system as claimed in claim 1, wherein the plurality of power sources are batteries.

10. The system as claimed in claim 9, wherein a charger is connected to the batteries.

11. The system as claimed in claim 10, wherein the charger is a single charger connected to all batteries.

12. A wellbore system comprising:

a borehole in a subsurface formation;

a string in the borehole; and an inflow control system as claimed in claim 1, disposed within or as a part of the string.

13. A method for managing inflow in a wellbore, comprising:

powering a plurality of inflow control devices (ICDs) with a plurality of power sources;

managing power distribution to the plurality of ICDs from the plurality of power sources with a downhole controller, wherein the managing includes monitoring of fluid properties in the plurality of ICDs and distributing power based upon the properties.

14. The method as claimed in claim 13, wherein the managing is diverting power from certain one(s) of the plurality of ICDs and supplying the diverted power to other one(s) of the plurality of ICDs.

15. The method as claimed in claim 13, wherein the managing is autonomous.

* * * * *